US009647778B2

(12) United States Patent
Hughes et al.

(10) Patent No.: US 9,647,778 B2
(45) Date of Patent: May 9, 2017

(54) METHOD AND APPARATUS FOR PROVIDING ADVERTISEMENT CORRELATION

(75) Inventors: George L. Hughes, Wesley Chapel, FL (US); Bhaskar R. Gudlavenkatasiva, Tampa, FL (US); Srinivas Soma, Tampa, FL (US); Umashankar Velusamy, Tampa, FL (US)

(73) Assignee: VERIZON PATENT AND LICENSING INC., Basking Ridge, NJ (US)

( * ) Notice: Subject to any disclaimer, the term of this patent is extended or adjusted under 35 U.S.C. 154(b) by 819 days.

(21) Appl. No.: 13/113,509

(22) Filed: May 23, 2011

(65) Prior Publication Data

US 2012/0304207 A1 Nov. 29, 2012

(51) Int. Cl.

| | |
|---|---|
| ***H04H 60/31*** | (2008.01) |
| ***H04H 60/33*** | (2008.01) |
| ***H04H 60/63*** | (2008.01) |
| ***H04H 60/66*** | (2008.01) |

(52) U.S. Cl.

CPC ..... *H04H 60/31* (2013.01); *H04H 60/33* (2013.01); *H04H 60/63* (2013.01); *H04H 60/66* (2013.01)

(58) Field of Classification Search

CPC ..... G06Q 30/02; G06Q 30/0242
USPC ..... 725/14
See application file for complete search history.

(56) References Cited

U.S. PATENT DOCUMENTS

| | | | | |
|---|---|---|---|---|
| 5,812,642 | A * | 9/1998 | Leroy | 379/92.01 |
| 8,484,677 | B1 * | 7/2013 | Eldering | G06Q 30/02 725/20 |
| 2005/0235318 | A1 * | 10/2005 | Grauch | G06Q 30/02 725/46 |
| 2005/0251445 | A1 * | 11/2005 | Wong | G06Q 30/02 705/14.69 |
| 2007/0064889 | A1 * | 3/2007 | Michonski | G06Q 30/02 379/112.01 |
| 2008/0066127 | A1 * | 3/2008 | Schechinger | H04N 7/17318 725/106 |
| 2008/0091516 | A1 * | 4/2008 | Giunta | 705/10 |
| 2008/0133342 | A1 * | 6/2008 | Criou | G06Q 30/02 705/14.41 |
| 2008/0263458 | A1 * | 10/2008 | Altberg | H04L 12/66 715/757 |
| 2009/0030780 | A1 * | 1/2009 | York et al. | 705/10 |
| 2009/0049468 | A1 * | 2/2009 | Shkedi | G06Q 30/0241 725/34 |
| 2009/0157511 | A1 * | 6/2009 | Spinnell | G06Q 30/02 705/14.1 |
| 2010/0106569 | A1 * | 4/2010 | Grimes | G06Q 30/02 705/14.1 |
| 2010/0287580 | A1 * | 11/2010 | Harding et al. | 725/14 |
| 2011/0022459 | A1 * | 1/2011 | Milanese | G06Q 30/02 705/14.45 |
| 2011/0023060 | A1 * | 1/2011 | Dmitriev et al. | 725/34 |

(Continued)

*Primary Examiner* — Nathan Flynn
*Assistant Examiner* — Alexander Q Huerta

(57) ABSTRACT

An approach is provided for enabling advertisers to correlate a communication session with an amount of consumption of the advertisement by a viewer. A correlation platform tracks an amount of consumption of an advertisement presented via a set-top box associated with a user. The amount of consumption of the advertisement is then correlated to a communication session initiated by the user in response to the presentation of the advertisement.

19 Claims, 8 Drawing Sheets

(56) References Cited

U.S. PATENT DOCUMENTS

| | | | | |
|---|---|---|---|---|
| 2011/0066498 | A1* | 3/2011 | Wojcicki | G06Q 30/02 705/14.55 |
| 2012/0002795 | A1* | 1/2012 | Berk | G06Q 30/02 379/114.01 |
| 2012/0036006 | A1* | 2/2012 | Mauro | G06Q 30/0243 705/14.42 |
| 2012/0096491 | A1* | 4/2012 | Shkedi | H04N 21/4532 725/35 |
| 2012/0221406 | A1* | 8/2012 | Kruhoeffer | G06Q 30/02 705/14.41 |
| 2013/0332261 | A1* | 12/2013 | Kothari | G06Q 30/02 705/14.42 |
| 2016/0012471 | A1* | 1/2016 | Fisher | G06Q 30/0242 705/14.41 |

* cited by examiner

100

400

403

405

600

METHOD AND APPARATUS FOR PROVIDING ADVERTISEMENT CORRELATION

BACKGROUND INFORMATION

Many advertisers pay to have their advertisements featured via a set-top box (STB) FOR display of along with regularly scheduled television content, on demand programming and premium broadcasting. The advertisement may include details regarding the product or service, contact information such as a phone number or web address of the advertiser, pricing information and other details intended to drive viewer interest in the product or service. While television advertising has the potential to reach millions of viewers, the advertiser is usually limited in their ability to understand the effectiveness of the advertisement, especially as it pertains to viewers contacting the advertiser in response to the advertisement. Unfortunately, relevant data for correlating the viewer's contact activity regarding the product or service—i.e., placement of a phone call or accessing of a website—with actual consumption of the advertisement by the viewer is not available.

Therefore, there is a need for an approach that provides flexible, efficient techniques to enable advertisers to correlate a communication session with an amount of consumption of the advertisement by a viewer.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DESCRIPTION OF THE PREFERRED EMBODIMENT

A preferred apparatus, method, and software for enabling advertisers to correlate a communication session with the amount of consumption of the advertisement by a viewer are described. In the following description, for the purposes of explanation, numerous specific details are set forth in order to provide a thorough understanding of the preferred embodiments of the invention. It is apparent, however, that the preferred embodiments may be practiced without these specific details or with an equivalent arrangement. In other instances, well-known structures and devices are shown in block diagram form in order to avoid unnecessarily obscuring the preferred embodiments of the invention.

Although various exemplary embodiments are described with respect to advertisements presented in the form of television content via a set-top box, it is contemplated that these embodiments have applicability to any media content capable of being presented including broadcasts, digital media, on demand programming, streaming media and the like. Additionally, the various embodiments have applicability to any device capable of processing audio-video (AV) signals for presentation to a user, such as a home communication terminal (HCT), a digital home communication terminal (DHCT), a stand-alone personal video recorder (PVR), a television set, a digital video disc (DVD) player, a video-enabled phone, an AV-enabled personal digital assistant (PDA), and/or a personal computer (PC), as well as other like technologies and customer premises equipment (CPE). Furthermore, although the STB is explained in the context of call events, it is contemplated that other device events relating to various services and functions are applicable.

Figure 1:
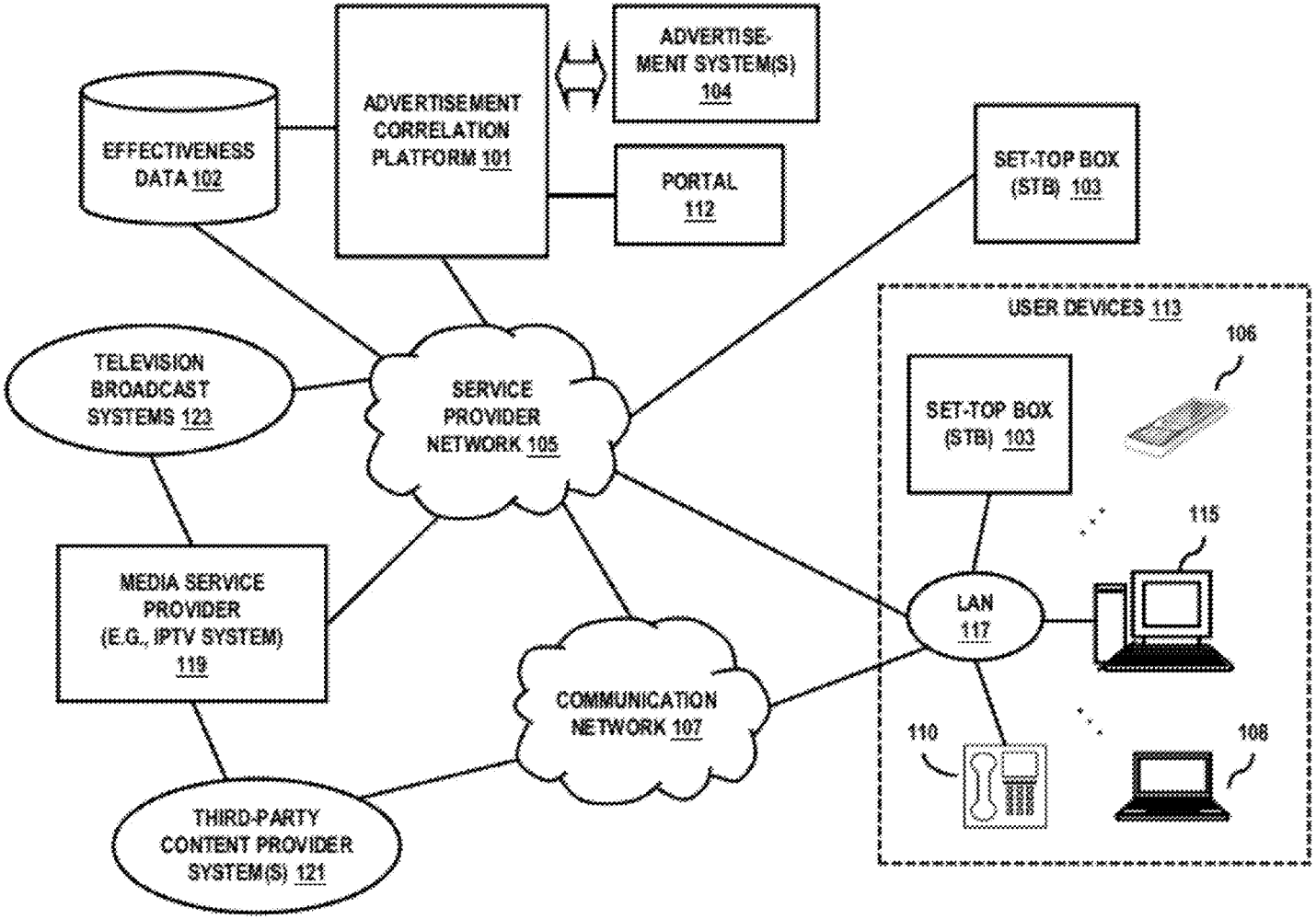
FIG. 1 is a diagram of a system capable of enabling advertisers to correlate a communication session with the amount of consumption of the advertisement by a viewer, according to an exemplary embodiment.

FIG. 1 is a diagram of a system capable of enabling advertisers to correlate a communication session with the amount of consumption of the advertisement by a viewer, according to an exemplary embodiment. For the purpose of illustration, system 100 is described with respect to an advertisement correlation platform (or platform) 101 that is configured to interface with one or more set-top boxes (STBs) 103 and other devices 113 associated a user (e.g., a viewer) through a service provider network 105 and/or communication network 107. A set-top box includes, for example, a device that connects to a television, media player, etc., and an external source of signal (e.g., media service provider 119), turning the signal into content which is then displayed on the television screen or other display device. Set-top boxes process signals for presenting audio-visual content (e.g., broadcast television programs, Video On Demand (VOD) programs, pay-per-view programs, Internet Protocol television (IPTV) feeds, DVD related content, etc.), pre-recorded media content, data communication services content (e.g., commercials, advertisements, videos, movies, songs, images, sounds, etc.), Internet services content (streamed audio, video, or image media), and/or any other equivalent media form. In this manner, media service provider (MSP) 119 may provide (in addition to their own media) content obtained from sources, such as one or more third-party content provider systems 121, one or more television broadcast systems 123, etc., as well as content available via one or more communication networks 107, etc. It is noted that this content may include advertisements, commercials, infomercials, direct selling media and other content provided by one or more advertisers who also interface with the correlation platform 101.

It is observed that television remains the prevalent global medium for entertainment and information as individuals spend a great deal of time tuning into both public television programs as well as paid televised media (e.g., cable television). Consequently, advertisers typically pay broadcast and media service providers a fee in order to have advertisements featured in connection with scheduled programming. In one embodiment, these advertisers may operate advertisement system(s) 104 to interact with correlation platform 101. According to certain embodiments, advertisement systems 104 can refer to computing and/or telecommunication systems associated with the advertisers for processing service or product orders. The advertisements vary in form and function, some being presented between portions of a program in, e.g., fifteen to thirty-second segments while others are presented as stand-along programs (e.g., infomercial, direct response media). In some instances, the advertisements may also be featured in conjunction with scheduled broadcast media as in-line content, banner ads, interactive content, etc. Typically, the advertisements include details regarding the product or service, contact information such as a phone number, web address or social networking handle of the advertiser, pricing information regarding the product or service, endorsement information, physical store location information and other data useful for encouraging viewers to pursue the offer.

While television advertising has the potential to reach millions of viewers, the advertiser is usually limited in their ability to understand the effectiveness of the advertisement, and particularly, the impact of the advertisement on enticing viewers to contact the advertiser regarding the product. This includes any means of contacting or initiating communication with an advertiser by a user (or subscriber), including by way of phone, chat, e-mail, web based communication and social networking. Also, advertisers typically deduce such information based on limited call center volume and web traffic data, extrapolating what they can from the results. In other instances, the advertisement system 104 may poll or survey the various viewers who place a call or access the web address to determine how they learned about the product or service, what aspects of the advertisement appealed to them, etc. Unfortunately, these approaches result in the compiling of inaccurate or incomplete data and do little to enable advertisers to pinpoint specific factors or characteristics of the advertisement that cause viewers to respond. Data for correlating the viewer's initiation of a communication session with an advertisement system 104 thereof in direct response to determined viewer consumption of the advertisement is not available.

Thus, the approach of system 100, according to certain embodiments, stems from the recognition that advertisers may benefit from information that correlates contact activity initiated by the user with the display and presentment of advertisements. The data collected by the correlation platform 101 can be provided to the advertisement system 104, which can distribute their content via various broadcast channels, media outlets and other advertisement mediums at an aggregate level. Data may be provided to the advertisement system 104 without presenting any personally identifiable information about the viewers to which the advertisements were directed. By way of this approach, the correlation platform 101 may be implemented as a service or hosted solution by a service provider (e.g., a communication services provider) for generating data that correlates viewing and communication habits and tendencies of one or more people. One or more advertisers may access the data by subscribing for access to the correlation platform 101.

By way of example, aggregation of such data, referred to in certain embodiments as effectivness data can be stored in a database 102, which can be used by advertisement system 104 to determine the most and/or least effective characteristics of their advertisements. The effectiveness data 102 may be used to enable advertisement system 104 to determine what time intervals or channels yield the greatest outcomes, how much of the advertisement is being consumed by viewers, the extent of penetration of linked advertisements (e.g., as part of a marketing campaign), opportunities for cost savings and marketing dollar usage, etc. The effectiveness data 102 can also be used by advertisement system 104 to engage in targeted adverting wherein a limited but more relevant number of viewers are targeted based on various factors. The data may be compiled based on one or more qualitative and/or quantitative metrics executed by the correlation platform 101, including those customized by respective advertisement systems 104 for enabling the generation of customized feedback. Hence, as advertisers vary in terms of product specialty, market approach, size and customer base, they may utilize different models and metrics to generate different effectiveness data types for accommodating their reporting needs.

In certain embodiments, a portal 112 interfaces with platform 101 to permit access by advertisement system 104 to any effectiveness data 102 by way of a communication network 107. Portal 112 provides, for example, a web-based user interface to allow advertisement system 104 to set and update advertiser profile information (e.g., as part of a registration or update process), define customized metrics for use in generation of effectiveness data 102 and various other features of the correlation platform 101. The portal may also be a means in which various advertisement systems 104 may access effectiveness data 102 in the form of one or more web-based reports or as a downloadable data file corresponding to a predetermined format, etc. It is noted that the correlation platform 101 may also be configured to transmit, via the portal 112, the effectiveness data 102 in accordance with a defined reporting frequency. By way of this approach, the portal may serve as a secure communication channel established between the service provider network 105 and the advertisement system 104, media service provider 119, television broadcast system 123, third-party content provider system 121 or other interested party.

The correlation platform 101 is configured to detect the initiation or execution of a communication session by one or more devices 113 belonging to a viewer. Hence, in certain embodiments, the correlation platform 101 may interface with and detect the generation of communication signals generated by a set-top box 103, a mobile (e.g., cellular) phone 106, a laptop computer 108, a telephone 110 and a desktop computing device 115. By way of example, the STB 103 may be integrated with the telephone 110 for supporting teleconferencing, web-based communication (e.g., Voice over IP) and the like. Respective devices 113 may also be configured to receive broadcast, media and content signals for rendering advertisements to a display. By way of example, cell phone 106 may be configured to receive television content on a live or streaming basis from over a communication network 107. As such, the cell phone 106 may be used to both initiate a call and receive content, including advertisements, for viewing. Hence, the correlation platform 101 may account for all forms of communication and/or content and media presentment devices and mechanisms available to users (e.g., viewers) to which advertisements may be directed.

Communication network 107 can include: a public data network (e.g., the Internet), various intranets, local area networks (LAN), wide area networks (WAN), the public switched telephony network (PSTN), integrated services digital networks (ISDN), other private packet switched networks or telephony networks, as well as any additional equivalent system or combination thereof. These networks may employ various access technologies including cable networks, satellite networks, subscriber television networks, digital subscriber line (DSL) networks, optical fiber networks, hybrid fiber-coax networks, worldwide interoperability for microwave access (WiMAX) networks, wireless fidelity (WiFi) networks, other wireless networks (e.g., 3G or 4G wireless broadband networks, mobile television networks, radio networks, etc.), terrestrial broadcasting networks, provider specific networks (e.g., fiber optic networks, cable networks, etc), and the like. Such networks may also utilize any suitable protocol supportive of data communications, e.g., transmission control protocol (TCP), internet protocol (IP), file transfer protocol (FTP), telnet, hypertext transfer protocol (HTTP), hypertext transfer protocol secure (HTTPS), asynchronous transfer mode (ATM), socket connections, Ethernet, frame relay, and the like, to connect content processing devices 103 to various sources of media content, such as one or more third-party content provider systems 121. Although depicted in FIG. 1 as separate networks, communication network 107 may be completely or partially contained within service provider network 105. For example, service provider network 105 may include facilities to provide for transport of packet-based communications.

According to certain embodiments, devices 113 may also be configured to communicate over one or more local area networks (LANs) 117 corresponding to the user (e.g., viewer). In this manner, routers (not shown) may be used for establishing and operating, or at least connecting to, a network such as a "home" network or LAN 117, and is used to route communications among various interconnected devices 113. For example, set-top box 103 may be communicatively coupled to LAN 117 via a router and a coaxial cable, whereas devices 115, 108 and 106 may be connected to LAN 117 via a router and a wireless connection, a network cable (e.g., Ethernet cable), and/or the like. It is noted, however, that in certain embodiments set-top box 103 may be configured to establish connectivity with LAN 117 via one or more wireless connections. Further, set-top box 103, wireless devices 106 and 108, phone 110 and computing device 115 may be uniquely identified by LAN 117 via any suitable addressing scheme. For example, LAN 117 may utilize the dynamic host configuration protocol (DHCP) to dynamically assign "private" DHCP internet protocol (IP) addresses to set-top box 103 and devices 113, i.e., IP addresses that are accessible to the devices 113 that are part of the LAN 117 facilitated via a router.

Figure 2:
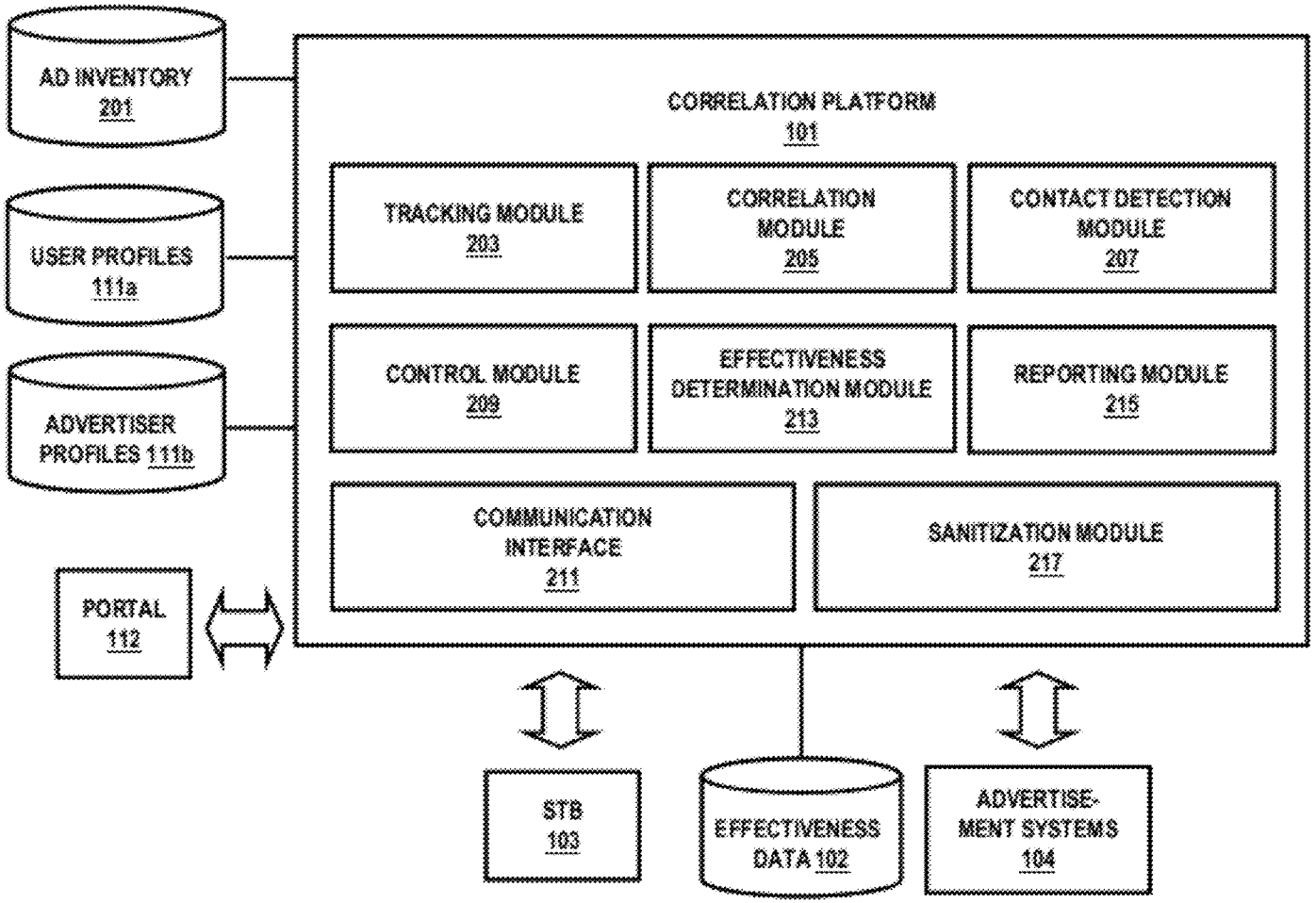
FIG. 2 is a diagram of a correlation platform, according to an exemplary embodiment.

FIG. 2 is a diagram of a correlation platform, according to an exemplary embodiment. The correlation platform (or platform) 101 may comprise computing hardware (such as described with respect to FIG. 5), as well as include one or more components configured to execute the processes described herein for correlating a communication session related to a user with an advertisement, i.e., as presented a set-top box 103 or computer 115. In one implementation, platform 101 includes or otherwise has access to an ad inventory database 201, which stores the advertisements that have the corresponding identifiers; the inventory can serve as a baseline for comparing the user view data, for instance. Additionally, platform 101 includes a communication interface 211, tracking module 203, correlation module 205, contact detection module 207, control module 209, effectiveness determination module 213, reporting module 215 and sanitization module 217. According to one embodiment, various combinations or all of these modules 203-217 can be implemented within a set-top box 103 itself.

In addition, the correlation platform 101 also maintains user profile data 111*a* and advertiser profile data 111*b* pertaining to the users (e.g., television viewers) and advertisers who advertise to the viewers. By way of example, the user profile data 111*a* may include data for identifying the user, including a user identifier value or code. Also, the user profile data 111*a* may include data specifying the name, address and other contact details of the user. Still further, the user profile data 111*a* specifies the one or more user devices 113 that are to be configured to the correlation platform for the purpose of detecting communication session activity or content/media consumption activity. For example, the user may specify that their cell phone 106, laptop 108 or video game system be connected to the correlation platform 101 as part of their user profile.

The advertiser profile data 111*b* includes data for identifying the advertiser, including an advertiser identifier value or code. The advertiser identifier value or code may be used in connection with an advertisement displayed to the set-top box for identifying the originator of the advertisement. Also, the advertiser profile data 111*b* may include data for specifying the name, address and other contact details of the advertiser including a contact phone number, e-mail address, web address or social networking handle. Still further, the advertiser profile may include data for indicating one or more advertisements made available for presentment to viewers—i.e., Advertisement A and Advertisement B. It is noted that advertisement system 104 establishes a profile during initial registration or subscription with the correlation platform 101.

In one embodiment, the communication interface 211 provides connectivity to one or more user devices 113 available to and designated by a user (e.g., viewer), as well as enabling the various interfaces required to configure to a router/LAN 117. Interface 211 can also communicate with various service provider systems 105 or communication systems 107 for supporting network communication and interaction. Still further, the communication interface 211 can also support execution of a web portal 112 for enabling advertisement system 104 to access platform 101 via a browser application or the like, such as for accessing effectiveness data 102.

In one embodiment, a tracking module 203 maintains data for indicating the rate, level or amount of consumption of an advertisement by a viewer as it is rendered to a display of the set-top box 103 (or computer 115 and other devices 113). This module 203 may initiate or directly exchange signaling with the relevant STBs 103 to acquire such data. By way of example, the tracking module 203 tracks the number of times the user has viewed a given advertisement as well as the amount of time elapsed during each viewing. Time is recorded at the beginning and end of play of the advertisement, including when the advertisement is interrupted due to the viewer changing channels, starting of an external device such as a DVD player, or the like. The tracking module 203 also tracks which channels the advertisement was featured on at a given time as well as relevant time zone and network data. This data is maintained by the tracking module 203 in association with the advertiser profile data 111*b* and user profile data 111*a*. As such, the contact information associated with a given advertisement, including a phone number or web address, may be associated with a specific time period of display. This data may be tracked over a predetermined time period—i.e., over a week, month, quarter, etc.

It is noted that the tracking module 203 may be configured for operation in connection with differing set-top boxes 103 as well as other media presentment devices (e.g., computing device 115). As such, the tracking module 203 may interpret media or advertising based content as directed to the set-top box 103 or other devices 113 by one or more broadcast systems 123, media service providers 119 or third-party content providers 121. As mentioned, module 203 may monitor the control signals generated by the STB 103 for rendering content to the display in conjunction with the specific application programming interfaces (APIs), graphics primitives, display features and operating system (OS) of the particular STB 103 or device 113. By way of this approach, details pertaining to the advertisement may be extrapolated during broadcast or play including contact information, product details, etc.

Also operating in connection with the tracking module 203, in one embodiment, is a contact detection module 207. The contact detection module 203 tracks information regarding the placement of a call, accessing of an IP address, transmission of an SMS message or other means of communication or contact initiated by the television viewer. In particular, the module 207 detects initiation of a communication session, i.e., via a control signal, corresponding to one of the user (viewers) devices 113 configured for operation over the service provider network 105 or communication network 107. The module 207 then determines the various contact information associated with the communication, such as the phone number, social networking handle, e-mail address or web address (internet protocol address) used to facilitate the session. This data is then passed on to the correlation module 205.

The correlation module 205, in one embodiment, analyzes the data gathered by the tracking module 203 and the contact detection module 207 to determine a correlation between an advertisement featured to the STB 103 and/or other devices 113 and a communication session initiated via at least one of the devices 113. The correlation is based, at least in part, on timing information for the advertisement and the call, along with contact information pertaining to the communication session. By way of example, the correlation module 205 determines if the contact information used to facilitate the communication session corresponds to that featured in the advertisement. Still further, the correlation module 205 then compares a start time corresponding to viewing of the advertisement with a time of initiation of the communication session as executed based on determined contact information. When the communication session is determined to be placed within a predetermined time (threshold) of tracked consumption of the advertisement by the viewer, the correlation module 205 flags the communication session as being related to the advertisement consumed. The threshold may be defined by the advertisement system 104 accordingly (e.g., within five minutes of ending of the advertisement, anytime during presentment of the advertisement).

In another embodiment, the effectiveness determination module 213 processes the data captured by the tracking module (e.g., length of time of viewing of an advertisement) as well as data captured by the contact detection module 207 against various effectiveness metrics. The metrics are configured by the one or more advertisers and/or content providers for determining the effectiveness of an advertising campaign, receptiveness of a user to specific programming, persuasiveness of a particular characteristic or feature of the advertisement, etc. In addition, the effectiveness determination module 213 operates in connection with a reporting module 215 in order to translate the metrics into a report that is presentable to the various advertisement systems 104. It is noted that the effectiveness determination module 213 operates in response to a determined correlation between a communication session and a consumed advertisement (e.g., advertisement based content) by the correlation module 205.

By way of example, the effectiveness determination module 213 may be configured to determine how many times the user (viewer) viewed an online advertisement for a given company against the number of times the user viewed the commercial via STB 103 prior to placing a call to the advertiser. Under this scenario, the advertiser may better understand the relationship and impact between the online advertisement and the commercial. As another example, the module 213 can determine how many times the user had seen the commercial on television (e.g., via the STB) prior to visiting the website of the advertiser. As such, the advertiser can determine how effective the online content is for enhancing the appeal of the advertisement. Various other qualitative calculations or analysis may also be performed.

As another example, the effectiveness determination module 213 may be configured, by virtue of one or more metrics, to recognize how much of the entire advertisement the viewer consumed prior to placing a call to an advertiser. For example, the user may have been switching between channels at the STB 103 and thus may have viewed the advertisement in the 10th minute of a 30 minute infomercial as opposed to from the very beginning. As mentioned previously, the start, stop or elapsed time of consumption is tracked accordingly by the tracking module 203. Hence, the advertiser may determine whether the user placed the call in the 12th minute or on the 28th minute of the advertisement. By trending this data over multiple samples (e.g., viewers), advertisement system 104 may evaluate the effectiveness of the first 10 minutes of the advertisement.

In certain embodiments, the reporting module 215 notifies one or more advertisement systems 104 of the effectiveness data or information generated with respect to a particular advertisement. By way of example, the reporting module 215 packages the effectiveness information and transmits it to the advertiser according to a predetermined frequency. The frequency may be established by the advertisement content provider to occur instantaneously, according to a threshold of users, based on an elapsed time period (e.g., every Tuesday), etc. In other instances, the report may be made available to advertisers by way of the portal 112.

It is noted that the effectiveness determination module 213 operates in connection with the reporting module 215 to present data for enhancing advertisers' ability to recognize various qualitative and/or quantitative characteristics regarding their advertisements, whether online or broadcast. In particular, the effectiveness data 102 may be utilized to assess how many times the user has seen a given advertisement, in which channels, at what time frames, prior to calling the advertiser. The provider of the correlation platform 101 can map this data over a period of time for reporting purposes (e.g., a day, week, month, etc.). Correlation between the placement of a call, initiation of a social networking session, advancement of an e-mail or other contact means and actual viewing of the advertisement presents advertisers with a more complete perspective of the impact of advertisements.

In certain embodiments, a sanitization module 217 aggregates the profiles of multiple users based on like characteristics and packages this information for use in connection with data generated by the effectiveness determination module 213 (effectiveness data 102). For example, the sanitization module 217 performs a composite analysis of various uses based on demographic factors—i.e., age, gender, socioeconomic status, device type, subscriber type, network and/or channel preferences, general location, etc. Specific identifying information of a user, such as their name, phone number or contact details is removed as part of the composite analysis process, thus enabling the generation of sanitized demographic data. This data may be used in connection with the data generated for conveying the effectiveness of an advertisement, including enabling the superimposition of such data in reports generated by the reporting module 215—i.e., as presented via the portal 112 or encoded in hardcopy form according to preferred document format.

While specific reference will be made to the above described implementation, it is also contemplated that platform 101 may embody many forms and include multiple and/or alternative components. For example, it is contemplated that the components of platform 101 may be combined, located in separate structures, and/or separate locations. By way of example, platform 101 may be implemented in accordance with a cloud-based server implementation. As another example, several of the components of the platform 101 may be integrated within a set-top box 103 for communication with various other components of the platform. In certain embodiments, a control module 209 regulates the execution and interaction of the various components of the platform 209 accordingly.

Figure 3B:
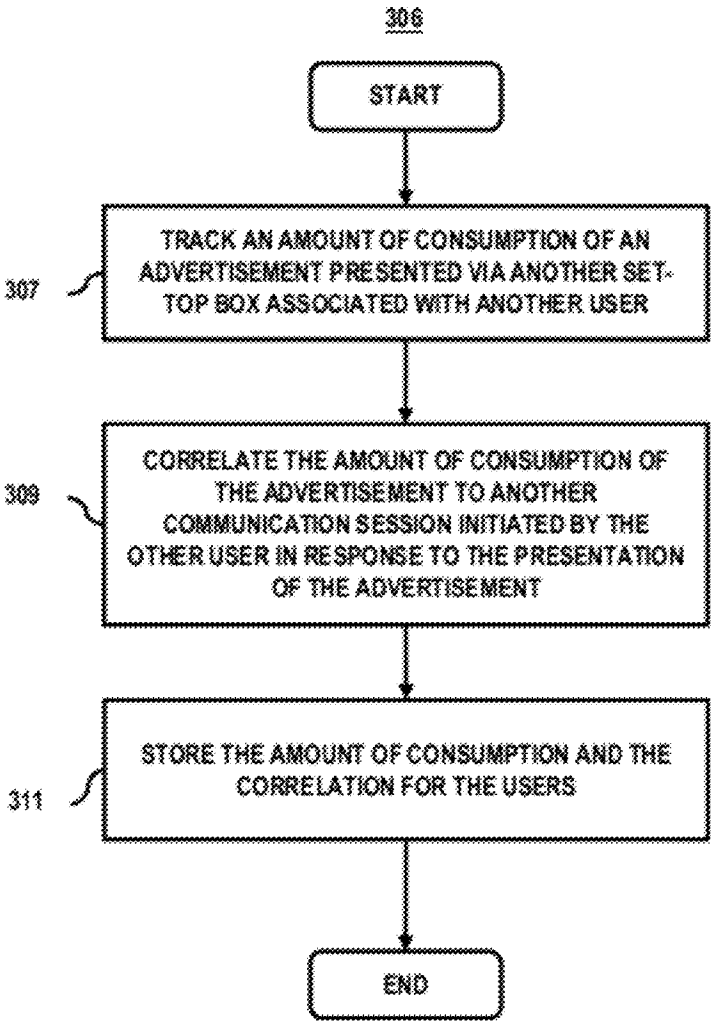
FIGS. 3A-3C are flowcharts of processes for enabling advertisers to correlate a communication session with the amount of consumption of the advertisement by a viewer, according to various embodiments.
Figure 3A:
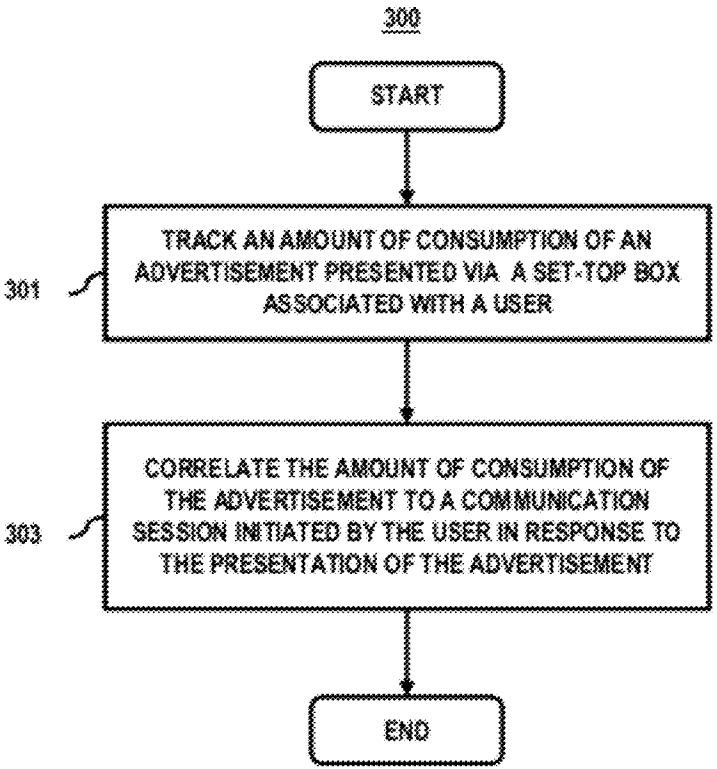
Figure 3C:
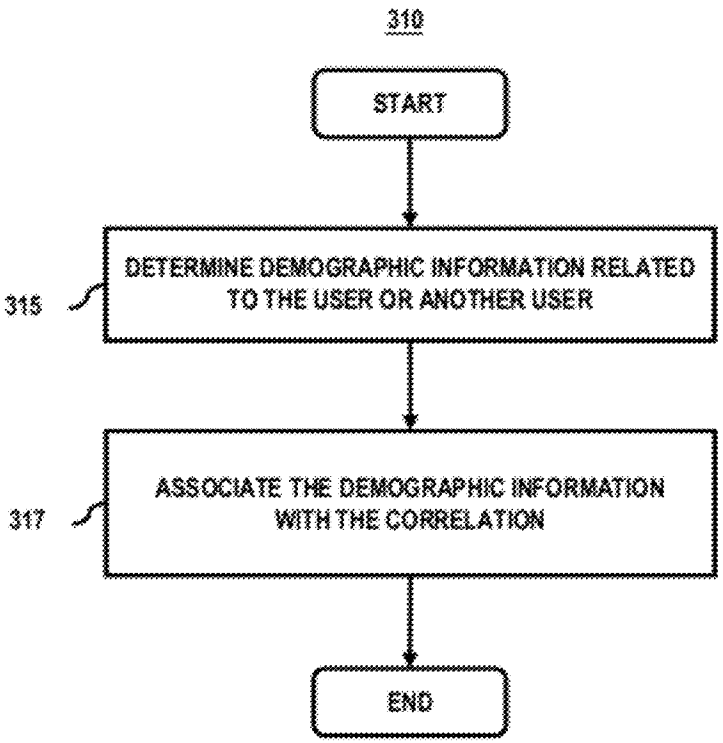

FIGS. 3A-3C are flowcharts of processes for enabling advertisers to correlate a communication session with the amount of consumption of the advertisement by a viewer, according to various embodiments. For the purpose of illustration, the processes are described with respect to FIG. 1. It is noted that the steps of the process may be performed in any suitable order, as well as combined or separated in any suitable manner. In step 301 of process 300, the correlation platform 101 tracks the amount of consumption of an advertisement presented via a set-top box associated with a user. The amount of consumption is tracked, by way of example, is a measure of the amount of time elapsed by the STB 103 in presenting an advertisement to a display for viewing by a viewer. As mentioned previously, the amount may correspond to an amount of time prior to execution of a call corresponding to the advertisement by the viewer. The amount of consumption may also be dependent upon an amount of time elapsed before a changing from or to the television channel in which the advertisement was featured, an amount of time elapsed before deactivation of the STB 103 or activation of a peripheral device (e.g., video game system) and other factors. The actual start time at which the advertisement is viewed, when applicable, is also accounted for by the platform 101.

Consumption is tracked, by way of example, according to various factors including: the number of times the advertisement was viewed; one or more channels in which the advertisement was viewed; data indicating user interest in an item related to the advertisement; a time frame corresponding to initiation of the communication session; a start, stop or elapsed time corresponding to viewing of the advertisement; or a combination thereof. Also, in certain embodiments, it is contemplated that the consumption may be expressed as a number, a percentage, an indicator (e.g., according to a star rating), an alphanumeric expression (e.g., 75% consumption), as a predetermined unit (e.g., 1 unit of airtime) or a combination thereof. When considered with respect to a broader time interval or other data, the consumption may also be captured as a rate for reporting purposes.

In step 303, the correlation platform 101 correlates the amount of consumption of the advertisement to a communication session initiated by the user in response to the presentation of the advertisement. By way of example, the correlation module 205 detects the initiation of a communication session by one or more devices 113 associated with the viewer; the session being initiated based on contact information as entered at or transmitted by the device via a network 105, 107. The contact information may include a phone number, web address, social networking handle or identifier, or other data for specifying a particular party to engage in a communication session with the viewer via the device. Hence, the communication session includes a voice call or a data session to access a website or social networking medium related to the advertisement.

The correlation process includes performing a check to determine whether the communication session is based on contact information pertaining to the advertiser. When a match is determined, the correlation process further includes comparing a start time corresponding to viewing of the advertisement with a time of initiation of the communication session. By way of example, a start time of viewing may correspond to a time of 2:30 pm and a time of initiation of the communication session corresponding to 2:37 pm, a time difference of 7 minutes. A correlation between these two times may be determined if they are within a predetermined threshold of one another—i.e., within 8 minutes of presentment of the advertisement. In one embodiment, the correlation process can exclude the amount of consumption that does not satisfy a predetermined threshold for the amount of consumption.

In certain embodiments, it is contemplated that contact information unrelated to the advertisers may also be maintained or tracked by the correlation platform 101 as influence data. Influence data may be any data useful for enabling the advertiser to determine a level of influence of others upon one or more viewers. By way of example, upon determining a similar amount of consumption of an advertisement, it may be observed that multiple users visit a particular web resource other than that of the advertisers. Repeated occurrences of this event may enable the advertisers to direct their advertising efforts at these resources or to somehow update any content they feature regarding their product and/or company via this resource. As another example, it may be observed that users of a younger demographic repeatedly initiate a communication session with a trusted third-party (e.g., parent, friend, mentor, etc.) at the eighth minute of a fifteen minute infomercial, where the eighth minute follows a portion of the advertisement featuring a popular cartoon character. Based on this trend, the advertisement system 104 may modify the advertisement to more directly encourage or incent viewers in this demographic to share information about the product or service with others. They may also feature the popular cartoon character more prominently and regularly throughout the advertisement due to the popular response.

In step 307 of process 306 (FIG. 3B), the correlation platform 101 tracks an amount of consumption of an advertisement presented via another set-top box associated with another user. In another step 309, the platform 101 correlates the amount of consumption of the advertisement to another communication session initiated by the other user in response to the presentation of the advertisement. Per step 311, the platform 101 stores the amount of consumption and the correlation for the plurality of users. As mentioned previously, the steps of FIG. 3B pertain to the aggregating of consumption data and correlation data for multiple users. From a reporting standpoint, this enables the advertisers to view effectiveness data 102 across a broad sampling of viewers for enabling a more reassuring assessment of their advertisements. The data may be aggregated and sanitized by the correlation platform 101 to prevent the sharing of sensitive information pertaining to the various viewers.

In step 315 of process 310 (FIG. 3C), the correlation platform 101 determines demographic information related to the user or another user. As mentioned previously, the demographic information may be extrapolated from user profile data 111*a* made available to the correlation platform 101. The demographic data may be based on various characteristics including age, gender, location, device type, etc. Per step 317, the correlation platform 101 associates the demographic information with the correlation. Based on this information, advertisers may adjust their advertisements to more effectively target certain viewers. By way of example, it may be determined that a particular community call response rate is 10%, but the elderly community response rate is 20%. The advertiser may adapt the advertisement to feature more spokespersons fitting the senior demographic. As another example, effectiveness data 205 for indicating receptivity or responsiveness to political ads in a particular geographical region (e.g., number of candidate site visits) may be channeled back to a political operation for deducing potential voter responsiveness, adapting campaign messaging, etc. It is noted, therefore, that the correlation platform 101 may be used for performing test marketing, polling verification and other uses.

Figure 4A:
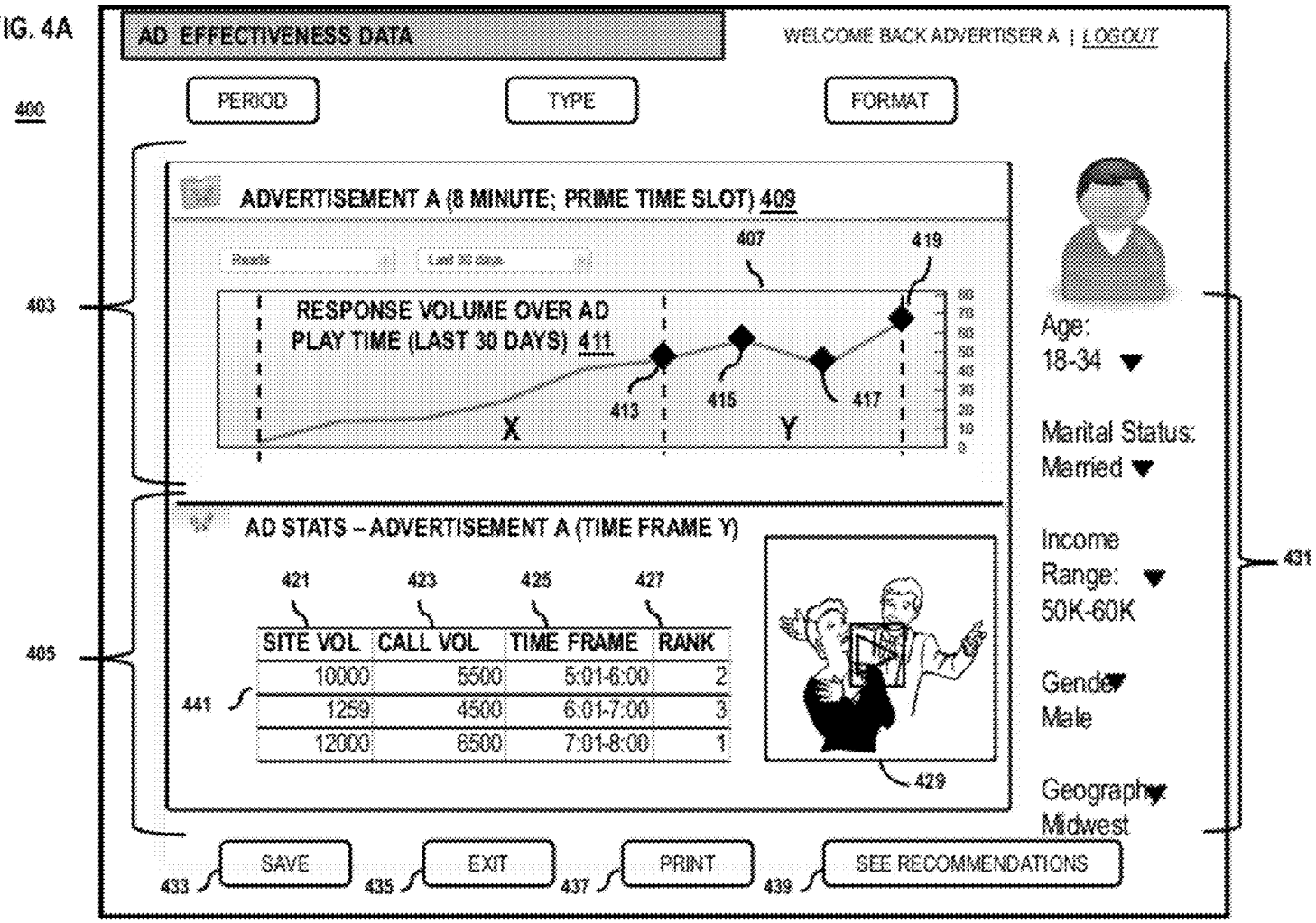
FIGS. 4A and 4B are diagrams of a user interface for presenting data for indicating the effectiveness of an advertisement, according to an exemplary embodiment.
Figure 4B:
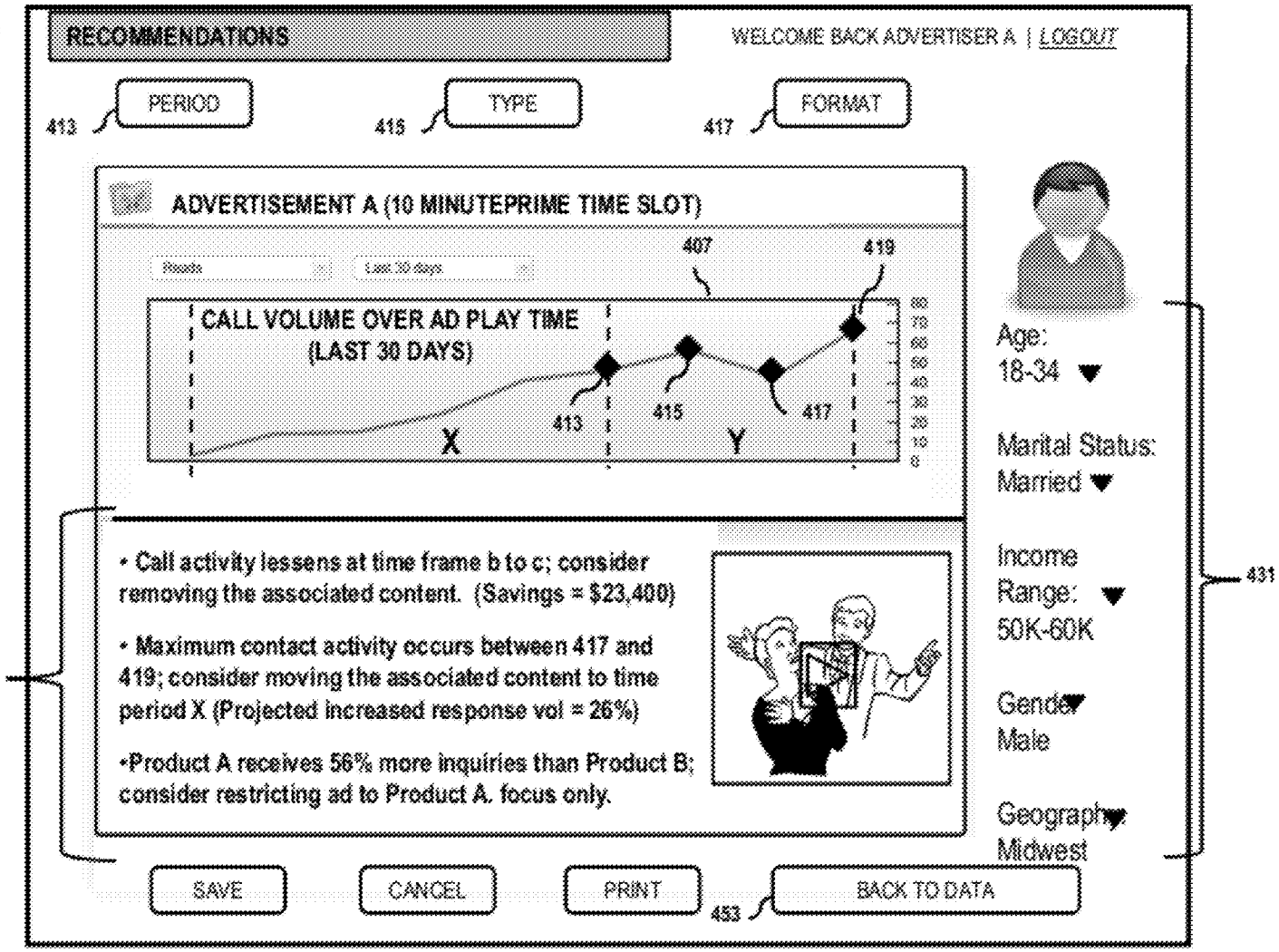

It is noted that the effectiveness data 102 may be generated based on one or more models, metrics, optimization formulas, performance ratios, industry valuation methods, etc. Compilation of a report for viewing by an advertiser may include various charts, indicators and graphics for conveying relevant information regarding an advertisement relative to call and/or site visit responsiveness. In addition, the data 102 may also be presented in the form of specific recommendations and/or considerations for the advertiser as deduced based on the applied metrics. FIGS. 4A and 4B are diagrams of a user interface for presenting data for indicating the effectiveness of an advertisement, according to an exemplary embodiment. For purposes of illustration, FIGS. 4A and 4B are described within the context of an exemplary use case of Advertiser A (e.g., advertising manager representing Advertiser A) interacting with the correlation platform 101 via a portal 112 to access effectiveness data 102 regarding Advertisement A.

In FIG. 4A, Advertiser A logs onto the correlation platform 101 via a browser interface and accesses an effectiveness data report view 400. One section 403 of the report features a graph 407 for representing call volume at various times of broadcast/play of Advertisement A. The x-axis corresponds to call volume, while the y-axis corresponds to a specific segment in time of Advertisement A. Data points used to generate the graph are based on the tracking of consumption and calls of multiple viewers over a 30 day period. Alternatively, the advertising manager may opt to select different reporting periods, report types or formats by selecting the "Change Period," "Change Type," and "Change Format" actions buttons 413-417 respectively. Selection of these buttons results in generation of a pop-up window or other menu selection means for enabling the advertising manager to adapt a setting. Similarly, the advertising management may select demographic profile settings for which to restrict the report to—i.e., by age, marital status, income range, gender and geography.

Under this scenario, Advertisement A is an 8 minute advertisement currently featured during a prime time slot (e.g., a higher cost to the advertiser). The report includes labels 409 and 411 for indicating the title and/or features of the advertisement and graph 407 respectively for enabling the user to conveniently navigate the report. Also, the graph 407 is analyzed by the advertising manager across successive time frames X and Y respectively. Time frame X corresponds to the first 5 minutes of Advertisement A while Y corresponds to the final 3 minutes of the advertisement. The advertising manager is interested in the data presented in time frame Y, which is also shown in the advertisement statistics portion 405 of the report, as this corresponds to a newly added section of the advertisement (e.g., updated advertising content).

In section Y of the graph 407, it is shown that the time intervals in minutes and seconds from point 413 to 415 (5:01 to 6:00) and 417 to 419 (7:01 to 8:00) correspond to an increase in call volume while the interval from 415 to 417 (6:01-7:00) corresponds to a decrease in call volume. By way of example, table 441 of the advertisement statistics portion 405 of the report shows the site volume 421, call volume 423, time frame 425 data upon which section Y of the graph is generated. In addition, the table 441 also features rank data 427 for indicating which segments of Advertisement A (time intervals) are most effective based on overall viewer responsiveness—i.e., a measure of the sum of determined website volume 421 and call placement volume 423. Based on this information, the advertising manager is able to observe that the lower ranked interval at 6:01 to 7:00 is limiting the overall effectiveness of the advertisement.

Under this scenario, to determine the cause of the drop in call volume during this time interval, the advertising manager can decide to playback the advertisement corresponding to this interval via a media viewer 429 embedded in the report. During this time interval, the manager notices the background color featured in the advertisement is identical to the color of the featured phone number and web address of the advertiser (e.g., red background on red lettering). Consequently, the contact information is obscured, unlike that for the higher ranked intervals which feature a white background with black lettering. The advertising manager is presented with various action buttons for using this report, including a "Save" action button 433 for saving the data set as shown, a "Exit" action button 435 for exiting from the report, a "Print" action button 437 for printing the report and a "See Recommendations" action button 439 for being presented with one or more recommendations based on the data set presented.

Upon selecting the "See Recommendations" action button 439, the advertising manager is presented with a recommendations view 450. This view presents a section 451 of the report featuring one or more recommendations for the advertising manager. As noted, the recommendations are based on the above described scenario and data set. In addition, the recommendations may be based on one or more metrics or models, or alternatively, based on proprietary data available to the advertising manager such as budget data, marketing campaign data, project execution data, etc. By way of example, the recommendations include removing the portion of the advertisement at the lower ranked time interval to resulting in a savings of $23,400. Another recommendation is for the manager to move the associated content at the highest ranked interval to achieve a projected increase in responsiveness of 26%. Another recommendation includes restricting the ad to focus on a single product A, as represented by section Y of the graph 417, rather than product B as represented by section X of the graph 417. The advertising manager can go back to the previous effectiveness data view 400 by selecting the "Back To Data" action button 453. The manager can also view different or additional recommendations by adapting the demographic data settings 431.

It is noted that the exemplary methods and systems presented in various embodiments enable a means of convenient, efficient access to data for indicating the effectiveness of advertisements featured by way of a set-top box or other media presentment means. The consumption and communication session related data collected by the system allows advertisers to make informed decisions about advertisements as well as maximize the use of their advertising dollars. As another advantage, the effectiveness data may enable advertisers to generate targeted advertising that is more acutely aligned with tendencies within a given market or demographic. As yet another advantage, the correlation platform 101 is configured to provide specific reports on what specific parts of an advertisement are the most effective depending on when viewers place the calls, i.e., out of the 4000 calls, 2500 calls were placed after the 5th minute of the advertisement.

Still further, the system is configured to provide general responsiveness data as scoped by geography as well. For example, reports may be generated for indicating that the best time for an advertisement targeting college students in a given college community is between 4 PM-5 PM on Saturdays and 10 PM-11 PM on weekdays, as this corresponds to peak times of responsiveness (e.g., call activity, website viewing, etc.). In addition, data for indicating the number of times an advertisement was viewed before a call was made, since the day the advertisement was aired, since addition new features to the product, etc. can be tracked accordingly.

The processes described herein for enabling advertisers to correlate a communication session with the amount of consumption of the advertisement by a viewer may be implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 5:
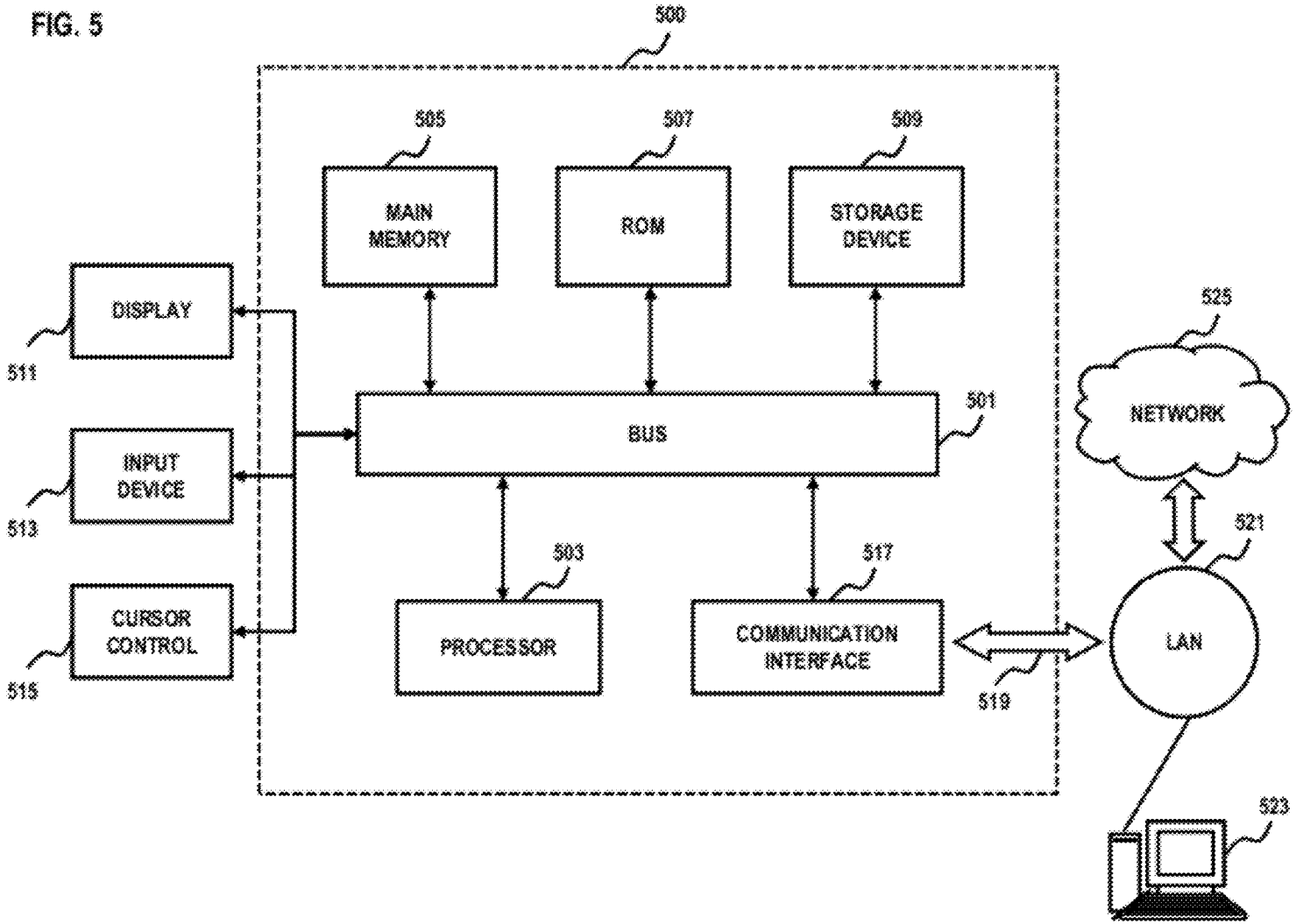
FIG. 5 is a diagram of a computer system that can be used to implement various exemplary embodiments.

FIG. 5 is a diagram of a computer system that can be used to implement various exemplary embodiments. The computer system 500 includes a bus 501 or other communication mechanism for communicating information and one or more processors (of which one is shown) 503 coupled to the bus 501 for processing information. The computer system 500 also includes main memory 505, such as a random access memory (RAM) or other dynamic storage device, coupled to the bus 501 for storing information and instructions to be executed by the processor 503. Main memory 505 can also be used for storing temporary variables or other intermediate information during execution of instructions by the processor 503. The computer system 500 may further include a read only memory (ROM) 507 or other static storage device coupled to the bus 501 for storing static information and instructions for the processor 503. A storage device 509, such as a magnetic disk or optical disk, is coupled to the bus 501 for persistently storing information and instructions.

The computer system 500 may be coupled via the bus 501 to a display 511, such as a cathode ray tube (CRT), liquid crystal display, active matrix display, or plasma display, for displaying information to a computer user. An input device 513, such as a keyboard including alphanumeric and other keys, is coupled to the bus 501 for communicating information and command selections to the processor 503. Another type of user input device is a cursor control 515, such as a mouse, a trackball, or cursor direction keys, for communicating direction information and command selections to the processor 503 and for adjusting cursor movement on the display 511.

According to an embodiment of the invention, the processes described herein are performed by the computer system 500, in response to the processor 503 executing an arrangement of instructions contained in main memory 505. Such instructions can be read into main memory 505 from another computer-readable medium, such as the storage device 509. Execution of the arrangement of instructions contained in main memory 505 causes the processor 503 to perform the process steps described herein. One or more processors in a multi-processing arrangement may also be employed to execute the instructions contained in main memory 505. In alternative embodiments, hard-wired circuitry may be used in place of or in combination with software instructions to implement the embodiment of the invention. Thus, embodiments of the invention are not limited to any specific combination of hardware circuitry and software.

The computer system 500 also includes a communication interface 517 coupled to bus 501. The communication interface 517 provides a two-way data communication coupling to a network link 519 connected to a local network 521. For example, the communication interface 517 may be a digital subscriber line (DSL) card or modem, an integrated services digital network (ISDN) card, a cable modem, a telephone modem, or any other communication interface to provide a data communication connection to a corresponding type of communication line. As another example, communication interface 517 may be a local area network (LAN) card (e.g. for Ethernet™ or an Asynchronous Transfer Model (ATM) network) to provide a data communication connection to a compatible LAN. Wireless links can also be implemented. In any such implementation, communication interface 517 sends and receives electrical, electromagnetic, or optical signals that carry digital data streams representing various types of information. Further, the communication interface 517 can include peripheral interface devices, such as a Universal Serial Bus (USB) interface, a PCMCIA (Personal Computer Memory Card International Association) interface, etc.

The network link 519 typically provides data communication through one or more networks to other data devices. For example, the network link 519 may provide a connection through local network 521 to a host computer 523, which has connectivity to a network 525 (e.g. a wide area network (WAN) or the global packet data communication network now commonly referred to as the "Internet") or to data equipment operated by a service provider. The local network 521 and the network 525 both use electrical, electromagnetic, or optical signals to convey information and instructions. The signals through the various networks and the signals on the network link 519 and through the communication interface 517, which communicate digital data with the computer system 500, are exemplary forms of carrier waves bearing the information and instructions.

The computer system 500 can send messages and receive data, including program code, through the network(s), the network link 519, and the communication interface 517. In the Internet example, a server (not shown) might transmit requested code belonging to an application program for implementing an embodiment of the invention through the network 525, the local network 521 and the communication interface 517. The processor 503 may execute the transmitted code while being received and/or store the code in the storage device 509, or other non-volatile storage for later execution. In this manner, the computer system 500 may obtain application code in the form of a carrier wave.

The term "computer-readable medium" as used herein refers to any medium that participates in providing instructions to the processor 503 for execution. Such a medium may take many forms, including but not limited to computer-readable storage medium ((or non-transitory)—i.e., non-volatile media and volatile media), and transmission media. Non-volatile media include, for example, optical or magnetic disks, such as the storage device 509. Volatile media include dynamic memory, such as main memory 505.

Transmission media include coaxial cables, copper wire and fiber optics, including the wires that comprise the bus 501. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Various forms of computer-readable media may be involved in providing instructions to a processor for execution. For example, the instructions for carrying out at least part of the embodiments of the invention may initially be borne on a magnetic disk of a remote computer. In such a scenario, the remote computer loads the instructions into main memory and sends the instructions over a telephone line using a modem. A modem of a local computer system receives the data on the telephone line and uses an infrared transmitter to convert the data to an infrared signal and transmit the infrared signal to a portable computing device, such as a personal digital assistant (PDA) or a laptop. An infrared detector on the portable computing device receives the information and instructions borne by the infrared signal and places the data on a bus. The bus conveys the data to main memory, from which a processor retrieves and executes the instructions. The instructions received by main memory can optionally be stored on storage device either before or after execution by processor.

Figure 6:
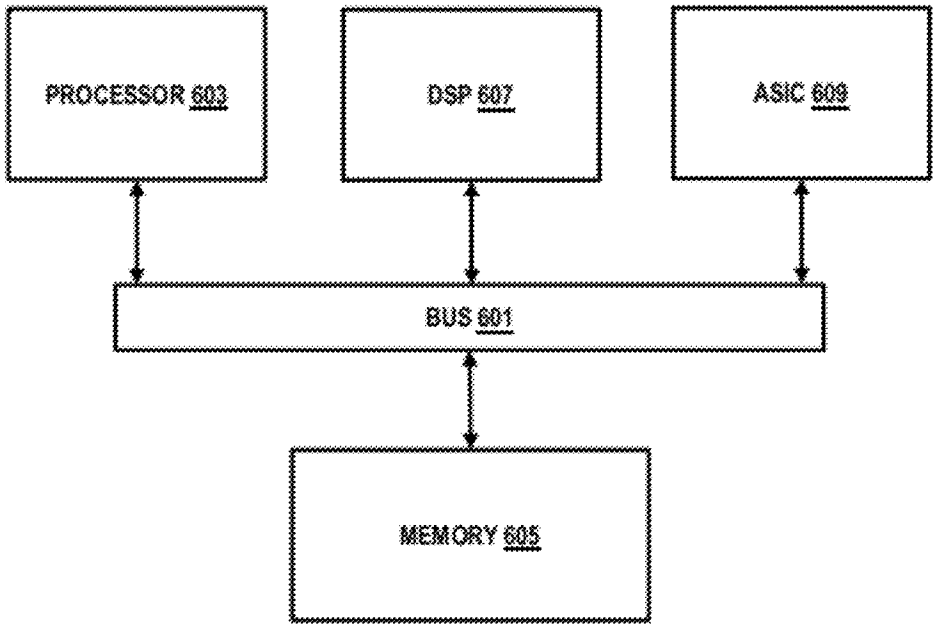
FIG. 6 is a diagram of a chip set that can be used to implement various exemplary embodiments.

FIG. 6 illustrates a chip set or chip 600 upon which an embodiment of the invention may be implemented. Chip set 600 is programmed to enable advertisers to correlate a communication session with the amount of consumption of the advertisement by a viewer as described herein and includes, for instance, the processor and memory components described with respect to FIG. 5 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 600 can be implemented in a single chip. It is further contemplated that in certain embodiments the chip set or chip 600 can be implemented as a single "system on a chip." It is further contemplated that in certain embodiments a separate ASIC would not be used, for example, and that all relevant functions as disclosed herein would be performed by a processor or processors. Chip set or chip 600, or a portion thereof, constitutes a means for performing one or more steps of enabling advertisers to correlate a communication session with the amount of consumption of the advertisement by a viewer.

In one embodiment, the chip set or chip 600 includes a communication mechanism such as a bus 601 for passing information among the components of the chip set 600. A processor 603 has connectivity to the bus 601 to execute instructions and process information stored in, for example, a memory 605. The processor 603 may include one or more processing cores with each core configured to perform independently. A multi-core processor enables multiprocessing within a single physical package. Examples of a multi-core processor include two, four, eight, or greater numbers of processing cores. Alternatively or in addition, the processor 603 may include one or more microprocessors configured in tandem via the bus 601 to enable independent execution of instructions, pipelining, and multithreading. The processor 603 may also be accompanied with one or more specialized components to perform certain processing functions and tasks such as one or more digital signal processors (DSP) 607, or one or more application-specific integrated circuits (ASIC) 609. A DSP 607 typically is configured to process real-world signals (e.g., sound) in real time independently of the processor 603. Similarly, an ASIC 609 can be configured to performed specialized functions not easily performed by a more general purpose processor. Other specialized components to aid in performing the inventive functions described herein may include one or more field programmable gate arrays (FPGA) (not shown), one or more controllers (not shown), or one or more other special-purpose computer chips.

In one embodiment, the chip set or chip 600 includes merely one or more processors and some software and/or firmware supporting and/or relating to and/or for the one or more processors.

The processor 603 and accompanying components have connectivity to the memory 605 via the bus 601. The memory 605 includes both dynamic memory (e.g., RAM, magnetic disk, writable optical disk, etc.) and static memory (e.g., ROM, CD-ROM, etc.) for storing executable instructions that when executed perform the inventive steps described herein to enable advertisers to correlate a communication session with the amount of consumption of the advertisement by a viewer. The memory 605 also stores the data associated with or generated by the execution of the inventive steps.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A method for providing correlated effectiveness data about an advertisement, the method comprising:

storing, utilizing a processor, user profile data and advertiser profile data of one or more users and one or more advertisers, wherein the user profile data comprises user identifier codes identifying each user of a plurality of users, and specifies a plurality of user devices that said plurality of users may use to initiate respective consumptions of the advertisement and/or respective communication sessions based on contact information associated with the advertisement and utilized by respective users of the plurality of users in response to the advertisement, wherein the advertiser profile data comprise an advertiser identifier code identifying each advertiser;

tracking a presentation period of presenting the advertisement including a start time, an end time and one or more measures of an amount of time elapsed in presenting the advertisement;

detecting initiations of consumption of the advertisement via control signals corresponding to respective specified devices of the plurality of user devices, wherein the initiations of consumption occur during the presentation period of the advertisement;

tracking amounts of consumption of the advertisement presented via the respective specified devices associated with the respective users based on the tracked presentation period and the detected initiations of consumption of the advertisement, wherein the advertisement is associated with the advertiser identifier of an advertiser originating the advertisement;

detecting initiations of a plurality of the communication sessions involving the contact information via control signals associated with the respective users in the plurality of users;

correlating the detecting of the initiations of the communication sessions and the detecting of the initiations of consumption of the advertisement with the tracked amounts of consumption of the advertisement and the tracked presentation period of presenting the advertisement, wherein correlating the amounts of consumption tracked includes determining a number of times the advertisement was viewed by a user and an amount of time elapsed during each viewing, wherein the correlating comprises comparing a time of an initiation of a consumption of the advertisement with a time of initiation of a communication session to determine whether the two times of initiation are within a predetermined time threshold of one another, wherein the correlating excludes an amount of consumption that does not satisfy a predetermined threshold for an amount of consumption based on a detected initiation of consumption and a tracked presentation period of the advertisement;

wherein, if the user views the advertisement a plurality of times, the correlating comprises determining a number of times the user views the advertisement prior to initiating the communication session, on which channels the advertisement was viewed, and at what time frames the advertisement was viewed; and generating effectiveness data about the advertisement based on the tracked presentation period, the detected initiations of consumption of the advertisement, the tracked amounts of consumption of the advertisement, the detected initiations of the communication sessions and the correlating.

2. A method according to claim 1, the method further comprising:

determining effectiveness of content of the advertisement utilizing the generated effectiveness data; and determining time intervals and channels that yield a desired outcome utilizing the generated effectiveness data, wherein the initiations of the communication sessions occur during the presentation period of the advertisement, wherein the correlating is based on contact information included in the advertisement, and the contact information is utilized for establishment of the communication session.

3. A method according to claim 2, wherein the contact information includes a phone number, a web address, a social networking identifier, or a combination thereof and the communication session includes a voice call or a data session to access a website or social networking medium related to the advertisement.

4. A method according to claim 1, wherein the amount of consumption tracked further includes duration of the presentation of the advertisement, the method further comprising:

generating report information specifying the duration relative to the initiation of the communication session.

5. A method according to claim 1, wherein the amount of consumption tracked further includes either one or more channels in which the advertisement was viewed; data indicating user interest in an item related to the advertisement; a time frame corresponding to initiation of the communication session; a start, stop or elapsed time corresponding to viewing of the advertisement; or a combination thereof.

6. A method according to claim 1, further comprising:

determining demographic information related to the plurality of users; and associating the demographic information with the correlation.

7. A method according to claim 1, further comprising:

tracking amounts of consumption of the advertisement presented via another device associated with another user;

correlating the amounts of consumption of the advertisement to another communication session initiated by the other user in response to the presentation of the advertisement; and storing the amounts of consumption and the correlation for the plurality of users.

8. A method according to claim 1, wherein the generated correlated effectiveness data about the advertisement provides information configured to increase understanding regarding the effectiveness of at least a part of the advertisement, wherein the generated correlated effectiveness data about the advertisement provides information configured to enable the advertiser to identify specific factors or characteristics of the advertisement that are associated with causing a user to respond to the advertisement, wherein the generated correlated effectiveness data about the advertisement provides information configured to correlate a user's initiation of a communication session with an advertisement system in direct response to a determined consumption of the advertisement associated with the user.

9. An apparatus for providing correlated effectiveness data about an advertisement, the apparatus comprising:

at least one processor; and at least one memory including computer program code for one or more programs, the at least one memory and the computer program code configured to, with the at least one processor, cause the apparatus to perform at least the following, store user profile data and advertiser profile data of one or more users and one or more advertisers, wherein the user profile data comprises user identifier codes identifying each user of a plurality of users, and specifies a plurality of user devices that said plurality of users may use to initiate respective consumptions of the advertisement and/or respective communication sessions based on contact information associated with the advertisement and utilized by respective users of the plurality of users in response to the advertisement, wherein the advertiser profile data comprise an advertiser identifier code identifying each advertiser, track a presentation period of presenting the advertisement including a start time, an end time and one or more measures of an amount of time elapsed in presenting the advertisement, detect initiations of consumption of the advertisement via control signals corresponding to respective specified devices of the plurality of user devices, wherein the initiations of consumption occur during the presentation period of the advertisement, track amounts of consumption of the advertisement presented via the respective specified devices associated with the respective users based on the tracked presentation period and the detected initiations of consumption of the advertisement, wherein the advertisement is associated with the advertiser identifier of an advertiser originating the advertisement, detect initiations of a plurality of the communication sessions involving the contact information via control signals associated with the respective users in the plurality of users;

correlate the detecting of the initiations of the communication sessions and the detecting of the initiations of consumption of the advertisement with the tracked amounts of consumption of the advertisement and the tracked presentation period of presenting the advertisement, wherein correlating the amounts of consumption tracked includes determining a number of times the advertisement was viewed by a user and an amount of time elapsed during each viewing, wherein the correlating comprises comparing a time of an initiation of a consumption of the advertisement with a time of initiation of a communication session to determine whether the two times of initiation are within a predetermined time threshold of one another, wherein the correlating excludes an amount of consumption that does not satisfy a predetermined threshold for an amount of consumption based on a detected initiation of consumption and a tracked presentation period of the advertisement, wherein, if the user views the advertisement a plurality of times, the correlating comprises determining a number of times the user views the advertisement prior to initiating the communication session, on which channels the advertisement was viewed, and at what time frames the advertisement was viewed, and generate effectiveness data about the advertisement based on the tracked presentation period, the detected initiations of consumption of the advertisement, the tracked amounts of consumption of the advertisement, the detected initiations of the communication sessions and the correlating.

10. An apparatus according to claim 9, the apparatus further caused to:

determine effectiveness of content of the advertisement utilizing the generated effectiveness data, and determine time intervals and channels that yield a desired outcome utilizing the generated effectiveness data, wherein the initiations of the communication sessions occur during the presentation period of the advertisement, wherein the correlating is based on contact information included in the advertisement, and the contact information is utilized for establishment of the communication session.

11. An apparatus according to claim 10, wherein the contact information includes a phone number, a web address, a social networking identifier, or a combination thereof and the communication session includes a voice call or a data session to access a website or social networking medium related to the advertisement.

12. An apparatus according to claim 9, wherein the amount of consumption tracked further includes duration of the presentation of the advertisement, the apparatus further caused to:

generate report information specifying the duration relative to the initiation of the communication session.

13. An apparatus according to claim 9, wherein the amount of consumption tracked further includes either one or more channels in which the advertisement was viewed; data indicating user interest in an item related to the advertisement; a time frame corresponding to initiation of the communication session; a start, stop or elapsed time corresponding to viewing of the advertisement; or a combination thereof.

14. An apparatus according to claim 9, wherein the apparatus is further caused, at least in part, to:

determine demographic information related to the plurality of users; and associate the demographic information with the correlation.

15. An apparatus according to claim 9, wherein the apparatus is further caused, at least in part, to track an amount of consumption of the advertisement presented via another device associated with another user;

correlate the amount of consumption of the advertisement to another communication session initiated by the other user in response to the presentation of the advertisement; and store the amount of consumption and the correlation for the plurality of users.

16. An apparatus according to claim 9, wherein the generated correlated effectiveness data about the advertisement provides information configured to increase understanding regarding the effectiveness of at least a part of the advertisement, wherein the generated correlated effectiveness data about the advertisement provides information configured to enable the advertiser to identify specific factors or characteristics of the advertisement that are associated with causing a user to respond to the advertisement, wherein the generated correlated effectiveness data about the advertisement provides information configured to correlate a user's initiation of a communication session with an advertisement system in direct response to a determined consumption of the advertisement associated with the user.

17. A non-transitory computer-readable storage medium carrying one or more sequences of one or more instructions which, when executed by one or more processors, cause a system to at least perform the following steps for providing correlated effectiveness data about an advertisement:

storing, utilizing a processor, user profile data and advertiser profile data of one or more users and one or more advertisers, wherein the user profile data comprises user identifier codes identifying each user of a plurality of users, and specifies a plurality of user devices that said plurality of users may use to initiate respective consumptions of the advertisement and/or respective communication sessions based on contact information associated with the advertisement and utilized by respective users of the plurality of users in response to the advertisement, wherein the advertiser profile data comprise an advertiser identifier code identifying each advertiser;

tracking a presentation period of presenting the advertisement including a start time, an end time and one or more measures of an amount of time elapsed in presenting the advertisement;

detecting initiations of consumption of the advertisement via control signals corresponding to respective specified devices of the plurality of user devices, wherein the initiations of consumption occur during the presentation period of the advertisement;

tracking amounts of consumption of the advertisement presented via the respective specified devices associated with the respective users based on the tracked presentation period and the detected initiations of consumption of the advertisement, wherein the advertisement is associated with the advertiser identifier of an advertiser originating the advertisement;

detecting initiations of a plurality of the communication sessions involving the contact information via control signals associated with the respective users in the plurality of users;

correlating the detecting of the initiations of the communication sessions and the detecting of the initiations of consumption of the advertisement with the tracked amounts of consumption of the advertisement and the tracked presentation period of presenting the advertisement, wherein correlating the amounts of consumption tracked includes determining a number of times the advertisement was viewed by a user and an amount of time elapsed during each viewing, wherein the correlating comprises comparing a time of an initiation of a consumption of the advertisement with a time of initiation of a communication session to determine whether the two times of initiation are within a predetermined time threshold of one another, wherein the correlating excludes an amount of consumption that does not satisfy a predetermined threshold for an amount of consumption based on a detected initiation of consumption and a tracked presentation period of the advertisement;

wherein, if the user views the advertisement a plurality of times, the correlating comprises determining a number of times the user views the advertisement prior to initiating the communication session, on which channels the advertisement was viewed, and at what time frames the advertisement was viewed; and generating effectiveness data about the advertisement based on the tracked presentation period, the detected initiations of consumption of the advertisement, the tracked amounts of consumption of the advertisement, the detected initiations of the communication sessions and the correlating.

18. A non-transitory computer-readable storage medium according to claim 17, further causing the a system to at least perform the following steps:

determining effectiveness of content of the advertisement utilizing the generated effectiveness data; and determining time intervals and channels that yield a desired outcome utilizing the generated effectiveness data, wherein the initiations of the communication sessions occur during the presentation period of the advertisement.

19. A non-transitory computer-readable storage medium according to claim 17, wherein the generated correlated effectiveness data about the advertisement provides information configured to increase understanding regarding the effectiveness of at least a part of the advertisement, wherein the generated correlated effectiveness data about the advertisement provides information configured to enable the advertiser to identify specific factors or characteristics of the advertisement that are associated with causing a user to respond to the advertisement, wherein the generated correlated effectiveness data about the advertisement provides information configured to correlate a user's initiation of a communication session with an advertisement system in direct response to a determined consumption of the advertisement associated with the user.

* * * * *